US006101636A

United States Patent [19]

Williams

[11] Patent Number: 6,101,636

[45] **Date of Patent: *Aug. 15, 2000**

[54] SCULPTURED HELMET ORNAMENTATION

[76] Inventor: Marix Williams, 4203 Lauber Way, #2, Tampa, Fla. 33614

[ * ] Notice: This patent issued on a continued prosecution application filed under 37 CFR 1.53(d), and is subject to the twenty year patent term provisions of 35 U.S.C. 154(a)(2).

[21] Appl. No.: 08/757,295

[22] Filed: Nov. 27, 1996

[51] Int. Cl.[7] ..... A42B 3/00

[52] U.S. Cl. ..... 2/410; 2/422

[58] Field of Search ..... 2/410, 411, 422, 2/412, 425, 205, 171, 209.13; D29/102, 103, 106; 446/27

[56] References Cited

U.S. PATENT DOCUMENTS

| | | | |
|---|---|---|---|
| D. 5,560 | 2/1872 | Watters | D102/301 |
| D. 11,176 | 4/1879 | Cairns | D102/301 |
| D. 171,492 | 2/1954 | Erickson et al. | D29/103 |
| D. 179,967 | 4/1957 | Erickson | D3/13 |
| D. 320,476 | 10/1991 | Mele | D29/13 |
| D. 330,950 | 11/1992 | Voepel | D29/106 |
| D. 382,370 | 8/1997 | Comstock et al. | D29/106 |
| D. 385,063 | 10/1997 | Anderson | D29/102 |
| D. 387,502 | 12/1997 | Comstock et al. | D29/106 |
| 2,296,335 | 9/1942 | Brady | 2/412 |
| 3,174,155 | 3/1965 | Pitman | 2/425 |
| 3,242,500 | 3/1966 | Derr | 2/412 |
| 3,435,460 | 4/1969 | Grant | 2/422 |
| 3,596,289 | 8/1971 | Adickes | 2/422 |
| 3,818,508 | 6/1974 | Lammers et al. | 2/412 |
| 4,586,200 | 5/1986 | Poon | 2/413 |
| 4,601,070 | 7/1986 | Sargentini | 2/422 |
| 5,399,602 | 3/1995 | Matsushita | 524/267 |
| 5,428,097 | 6/1995 | Kobayashi | 524/493 |
| 5,508,900 | 4/1996 | Norman | 2/422 |
| 5,516,832 | 5/1996 | Kennan | 524/493 |
| 5,713,082 | 2/1998 | Bassette et al. | 2/412 |
| 5,953,762 | 9/1999 | Corbett | 2/425 |

OTHER PUBLICATIONS

"The Perfectly Safe Catalog", p. 58, Dec. 1992.

Copyright 1993, Dow Corning Corporation, Dow Corning New Product Information, Silastic M RTV CIBA–GEIGY Corporation's Product Data, Formulated Materials Group, "Araldite 2043".

Wintune Graphics, Inc., Innovative Helmet Manufacturing, '96 Catalog.

*Primary Examiner*—Michael A. Neas

*Attorney, Agent, or Firm*—Sam Silverberg

[57] ABSTRACT

A helmet, preferably a motorcycle helmet, having a latex or rubbery three dimensional sculpture generally following the contour of the helmet adhered to the outer surface thereof. The three dimensional structure is permanently adhered to the outer surface of the helmet, preferably with an epoxy adhesive. The helmets bears a striking decoration and are capable of enduring in the environment of use of motorcycle helmets. The structures seem to be a part of, or evolve from, the helmet, and make possible for the first time three dimensional images.

19 Claims, 4 Drawing Sheets

SCULPTURED HELMET ORNAMENTATION

BACKGROUND OF THE INVENTION

1. Field of the Invention

The present invention relates to a new artistic approach for modifying a helmet having a generally two dimensional surface into a helmet displaying a three dimensional artistic sculpture or ornamentation. The sculpture or ornamentation, though added onto an existing helmet, appears to be an integral part of the helmet or to evolve out of the helmet. Even if provided with features having sharp projections, the sculpture is capable of enduring those conditions of heat, cold, abrasion, rain, and ultra-violet radiation to which helmets such as motorcycle helmets may be subjected. In addition to being highly decorative, the sculpture or ornament has an additional benefit in that it increases shock absorbency of the helmet and thus enhances safety.

2. Description of the Related Art

The present inventor worked in the field of customizing motorcycles for a number of years, mainly as a painter of artistic images and designs on motorcycle gas tanks and helmets. The most popular motifs include flames, skulls, flags, animals, and women.

With an air brush, in general, it is possible to use shading and artistic tricks to impart an impression of depth to an otherwise two-dimensional design. A good air brush artist can make many air-brushed images look three dimensional. For example, one popular form of three dimensional appearing design includes a "breakout" feature wherein, for example, a hand or claws or a ferocious animal would seem to tear through a metal gas tank or helmet, as though breaking out from inside the gas tank or helmet.

One problem associated with designs intended to have a three dimensional appearance is that the rendering of each design is labor intensive. For example, applying flames to a gas tank involves many stages of masking out. Each stage has to be done manually, a very long process. Further, customers are looking for even more depth than that achieved with conventional techniques.

While it is possible with an air brush to give an impression of depth, some images, such as an eagles, may be picturesque and popular but do not lend themselves to a three dimensional artwork. Thus, some designs are difficult or impossible to make three dimensional looking.

The inventor also noticed that many motor cycle riders were reluctant to wear helmets. Part of the reluctance came from the "wind blowing in my hair" attitude, but a major reason for non-use of helmets stems from the perception that motorcycle helmets are not image enhancing.

In the last 50 years no great advances have been made in the fashionability or appearance value of helmets. It would seem to be a great idea to be able to modify a helmet so that it is more attractive and safer.

In view of the above, the inventor considered that motorcycle helmet artwork is generally rendered on a flat (two-dimensional) surface. The inventor considered that he could be much more innovative with motorcycle helmet imaging and designs if he could provide either a non-painted three dimensional image surface to the helmet prior to painting, or to provide an artwork which is painted and ready to apply to a helmet such as a motorcycle helmet. The inventor considered that if these three dimensional designs enhanced the attractiveness of the helmet, the helmet would be more likely to be worn.

It has long been known to decorate a helmet with an ornamental structure such as buffalo horns, an eagle, or a figure, as shown, for example, in U.S. Pat. Nos. Des. 5,560, 11,176 and 179,967. Beginning with this conventional understanding, the inventor experimented with many different resins, trying to apply a shallow, helmet conforming sculpture or ornamentation to a helmet using fiberglass resins similar to those that helmets are originally made out of. However, after numerous attempts to render a motorcycle helmet three dimensional, the inventor discovered a number of problems. For example, there are problems with undercut, wherein features could not be imparted to highly convoluted or ornamental designs since it is necessary to form a mold in a manner that could be removed after casting the sculpture or ornament. Further, there were problems of projections or details snapping and breaking when the mold is removed. Further, due to inherent requirements for mold design, it was difficult to get the artwork to look as clean as needed.

Further, helmets come in a variety of shapes and sizes. A fiberglass ornamental designed to conform to one helmet will not necessarily fit another helmet having a different shape or size.

Further, if a helmet is provided with a fiberglass ornament having a sharp projection and the helmet is banged against a hard surface the projection will break off. If the same sharp projection is urged against a soft surface such as a motorcycle seat or human skin, it will pierce and tear the soft surface.

The inventor thus considered that there was a need for a new type of motorcycle helmet ornamentation which could be used to render a conventional helmet either as artistic as desired or as outrageous as desired. That is, motorcycle riders, when gathered at events such as those held at Sturgis or Daytona Beach, make extreme modifications to their motorcycles and wear exotic costumes and decorations in order to stand out and be noticed. Motorcycle helmets, in contrast, either have two dimensional designs such as stickers or artwork, or have ornaments affixed to the helmet, such as horns or fur, which ornaments are limited and neither appear to be a part of the helmet nor enhance the safety of the helmet. From experience attending motorcycle rallies, it becomes apparent that no one has been able to provide a motorcycle helmet with a three dimensional sculpture which is capable of being highly personalized, which appears to be an integral part of the helmet, which enhances safety, and which stands up to conditions of use of a motorcycle helmet.

The inventor investigated commercially available helmets and found no solution to the above problems. The following is representative of patents relating to helmet modifications.

U.S. Pat. No. 4,937,888 to Straus teaches an apparatus for protecting the wearer of a football helmet, the apparatus being in the form of a cap, and more specifically, a helmet conforming elastomeric cellular helmet cover. The helmet cover is attached to the exterior of an unmodified helmet by means of flexible tabs. The helmet cover increases the shock absorbency and resiliency of the helmet outer shell when football players practice, and thereby reduces the potential for injury to the wearer. The helmet cover is made thicker in those areas where impact is most likely to occur. While this helmet cover may contribute to low-impact shock absorbency, the helmet cover does not in any decorate the helmet or enhance the artistic appeal of a helmet. Further, the cap is not permanently attached to the helmet, and is clearly not intended to stand up to continuous use in the environment to which a motorcycle helmet is subjected.

U.S. Pat. No. 5,023,958 to Rotzin teaches a bicycle helmet made more aerodynamic by provision of ridges (17) across the top. These ridges cause air flow over the helmet to separate prior to the onset of turbulence and minimize buffeting of the helmet and reduce drag. The ridges are integrally molded into the helmet, and there is no teaching as to how to modify an existing helmet to render it artistically attractive.

U.S. Pat. No. 5,525,290 to Carpenter teaches a method for manufacturing a decorated helmet. The end product is, however, a two dimensional design which differs from three dimensional design with which the present inventor is concerned.

SUMMARY OF THE INVENTION

In a preferred embodiment, the invention concerns latex or rubbery structures capable of being adhered to a helmet, preferably a motorcycle helmet. The invention also concerns a method of adhering the structure to a helmet, and the ornamental helmets produced thereby.

In accordance with the present invention three dimensional structures are permanently adhered to the outer surface of the helmet, preferably with an epoxy adhesive. The helmets produced thereby bear a striking decoration, and are long lasting in the environment of use of motorcycle helmets, i.e., the structures survive banging and scratching.

The decorative structures are slightly flexible and are thus advantageous over hard fiberglass structures since according to the present invention sharp edges do not tend to break if impacted against a hard surface and sharp edges do not pierce the skin of a user, for example, if a helmet is impacted against the leg of a motorcyclist while carrying the helmet.

Further, while it may be difficult to conform a hard fiberglass structure to a motorcycle helmet, it is easy to conform a soft structure to any shape or size helmet.

The structures are painted, form a three dimensional yet integral part of the motorcycle helmet, are durable and long lasting, and have a unique feel as compared to a fiberglass motorcycle helmet surface. The structures may be highly diverse shapes such as a human brain, a vampire, a demon, skulls or flames.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other helmet sculptures or ornaments for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which:

FIG. 12 is a side view of a helmet.

DETAILED DESCRIPTION OF THE INVENTION

Figure 1:
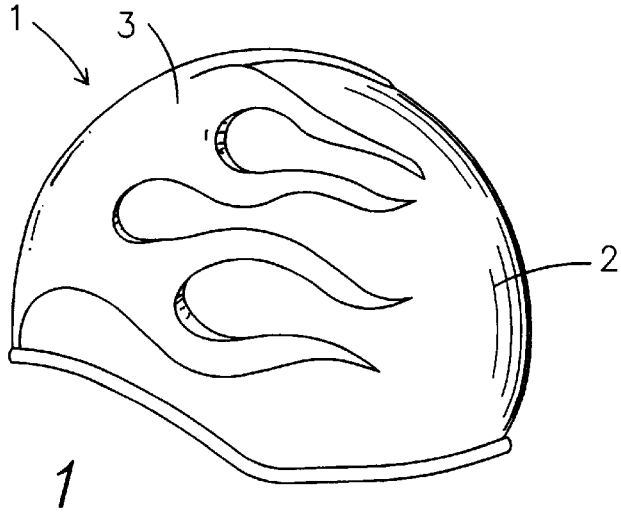
FIG. 1 is a side view of a first embodiment of the invention showing a three dimensional decorative flame ornament applied to a motorcycle helmet.

After extensive trial and error work with many hard resins, the inventor finally realized that for safety reasons it would be desirable to come up with a softer, more spongy variation of the helmet modifying material. The inventor was, at the time, working on a helmet cover which had the appearance of a brain, and realized that if the brain not only looked realistic but also felt realistic it would have a significant uniqueness factor. However, it went contrary to his understanding to provide a flexible material on an otherwise conventionally hard surface. A flexible material would seem prone to tearing, disfiguring, and loss of paint. After extensive experimentation, the inventor found materials which were durable in terms of tear and scratch resistance, held paint, and could be permanently adhered to a motorcycle helmet.

A first embodiment of the invention was a helmet which, when worn, had the appearance of an exposed brain. Not only did the outer soft shell look like a brain and feel like a brain, it had a high uniqueness factor, and due to the additional cushioning effect actually enhanced safety and helped to protect the brain.

Motorcyclists, when in a group, compete for attention. Motorcycle helmets modified according to the present invention would guarantee that the motorcyclist receives attention. Not only is the concept and visual appearance outrageous, but the "brain" has a novel feel. Observers will want to touch the helmet because of it's appearance, and will be surprised by the novel feel.

The softer external layer not only helps cushion the impact while the motorcycle rider wears the helmet, it also enhances safety since it helps to protect a helmet from a fall, for example, from a table top to the ground. Conventional fiberglass helmets may fracture or develop weaknesses from such a fall, and should be replaced or sent to the manufacturer for X-raying after a fall. The cushioning layer according to the present invention greatly reduces the impact to the fiberglass part of the helmet and thereby prolongs the life of the helmet.

Of course, if a biker were to fall, there is a possibility that the rubbery layer according to the present invention may actually reduce the risk of serious injuries because it has somewhat of a pillow effect.

Finally, an helmet this unique is more likely to be worn, if not for safety reasons that for appearance. A helmet is only effective when worn.

As discussed above, the inventor had to solve the problem of providing an external surface which was tough enough to hold up to the abrasion and knocks to which a helmet is exposed, yet have no concern that a custom design, once painted on, would abrade off. This problem was solved in two ways. First, there is difference between paints and dyes. The custom design could be applied by directly air brushing alcohol disperse dyes in preference to paints. Second, the entire article could be predyed so that even if abraded it would not loose color. After casting, the article is merely touched up, detailed, or color enhanced with minimal air brushing. The actual product could be made in a manner so as to minimize the amount of coloring and painting required to produce the final product. Further, the concern of scrapping, scratching and denting is alleviated by the provision of dyes inside of the rubber material. The rubber, resin or latex which has the primary coloring throughout will look good even after scratching or abrading.

The process used in the present invention to decorate the three- dimensional ornamentation thus may start with dyeing the rubber or latex figure with a basic or background color over which a further decoration can be applied. After the dyed ornament is molded into the desired ornamental shape, the image is colored or is touched up. This coloration be accomplished by any of a variety of industrial apparatus, but for customization, individualization and detail the inventor prefers to paint designs with an alcohol solvent based air brush paint or dye. One preferred air brush paint is distributed by Graphic Marker International Inc., of Chatsworth, Calif. 91311 under the name Studio Dye™ and comes mixed with an adhesion promoter which imparts a latex or rubber like quality and adheres to almost any surface. However, many commercially available alternatives could be substituted, including DEKA-SignAir™ of Decart Inc., Morrisville, Vt. 05661, Createx Pearlized™ or Createx Auto IR™ acrylic enamel of Createx Color, Granby, Conn. 06026, Dr., PH Martins Ready Tex™ texture paint by Salis International Inc., Hollywood, Fla. 33020, or a urethane spray paint mixture that includes cellulose acetate butyrate for control of defects when sprayed too heavily (U.S. Pat. No. 5,520,963 which is included for reference), a coating material which contains a thermosetting carboxy-hydroxy acrylic copolymer cross-linked by polyisocyanates, polypoxides, or aminoplast resins, and also containing cobalt metal organic dyes, and chrome metal organic dyes as used on automobiles (see U.S. Pat. No. 4,598,020 incorporated herein by reference), a latex paint where a distilled isocyanate is reacted with an alkynol to form urethane and then to form 3-iodo-2-propynylbutyl carbamate without the use of trialkyamine as a catalyst to prevent yellowing (see U.S. Pat. No. 5,554,784 incorporated herein by reference), or other specialized airbrush dyes or paint mixtures such as Chromabase™ etc.

For protection of the ornamental structure an ultraviolet absorber (UVA) is preferably either mixed into a clear coat or mixed directly in with the dye/paint, to prevent fading, discoloration or cracking from exposure to intense sunlight. Examples of suitable ultraviolet absorbers include benzotriazoles such as tinuvin 1130™, tinuvin p™, and tinuvin 384™ (trademark, CIBA GEIGY) which are added to the clear coat, ortho-hydroxybenzophenones; triphenyltriazines and oxanilides, which are added to the dye/paint, or an ultraviolet absorbing amino compound that contains a hydroxyphenyl group, one amino group, formaldehyde, and at least one alcohol, which is mixed with the dye/paint's basic compound and can be applied as a clear coat or with a inorganic or organic pigment added. More specific examples of ultraviolet absorbers include:

2-hydroxy-4-n-octoxybenzophenone,
2-(2'-hydroxy-5'-methylphenyl)-benzotriazole,
2-hydroxy-4-methoxybenzophenone,
2,2'-dihydroxybenzophenone,
2,2',4,4'-tetrahydroxybenzophenone,
2,2'-dihydroxy-4,4'-dimethoxybenzophenone,
2,2'-dihydroxy-4,4'diethoxybenzophenone,
2,2'-dihydroxy-4,4'-dipropoxybenzophenone,
2,2'-dihydroxy-4,4'-dibutoxybenzophenone,
2,2'-dihydroxy-4-methoxy-4'-ethoxybenzophenone,
2,2'-dihydroxy-4-methoxy-4'-propoxybenzophenone,
2,2'-dihydroxy-4-methoxy-4'-butoxybenzophenone,
2-(2'-hydroxy-5'-cyclo-hexylphenyl)benzotriazole,
2-(2'-hydroxy-3'-methyl-5'-tert-butylphenyl) benzotriazole,
2-(2'-hydroxy-5'-cyclo-hexylphenyl)benzotriazole,
2-(2'-hydroxy-3',5'-dimethylphenyl)benzotriazole,
ethyl 3,3'-diphenyl-2-cyanoacrylate,
octyl 3,3-diphenyl-2-cyanoacrylate, (Other examples of ultraviolet absorbers can be found in U.S. Pat. Nos. 5,487,914, 5,426,131, and 4,319,016, the disclosures of which are incorporated herein by reference). The purpose of the ultraviolet absorber is to prevent the color from fading, discoloring, or cracking under intense sunlight.

Since the ornament is flexible(to prevent breaking, ripping or tearing at any soft surface, and adding to the safety) the inventor was concerned with the flexibility of the dye/paint mixture to prevent cracking and peeling. For this the inventor chose a form of dye/paint mixture with a latex quality and a strong adhesive property or includes an adhesive promoter for preventing the color from peeling or flaking while withstanding the harsh environments of a motorcyclist. The adhesion promoter can consist of an acrylic or methacrylic polymer that is added to the coating composition. Many commercially available adhesion promoters are available on the market, for example: SC-462 of SONY Chemicals Co., ACRYPET VH of Mitsubishi Rayon Co., and PARAPET HR1000NP and PARAPET GF100 of Kyowa Gas Chemicals Co.(U.S. Pat. No. 5,130,365 which is included for reference). These adhesion promoters can be added to the dye/paint mixture to enhance the ability to withstand the abuse that a motorcyclist's helmet must endure.

Yet a further concern addressed by the inventor was loss of aerodynamic properties of the helmet due to the irregularly contoured surface of the helmet. All conventional helmets are generally flat on the outer surface. Being smooth on the outside is believed to be slippery for the wind, streamlined, and aerodynamic. A wrinkled, rough or sculptured surface would seem to interfere with the aerodynamics. However, it was found that a moderate amount of ridges even seemed to help break up the air, create sufficient turbulence to prevent drag. This is particularly true where sculptures extend only about ⅛ inch to ½ inch over the actual helmet itself, with the design is not fully developed but is partial so that once painted it looks like it were 3-D, i.e., like it is actually evolving out of the helmet.

While the main concept of the invention initially concerned motorcycle helmets, it is readily apparent that the same concept can be applied to bicyclists helmets, skateboarder helmets, rollerblader helmets, etc.

The decorative ornamental layer which adds relief to the external surface of the motorcycle helmet may be made of any rubbery material so long as the material has sufficient shape retentive characteristics as to retain the desired ornamental or decorative shape. The ornament is preferably sufficiently pliable or rubbery to the touch to impart a unique feel to the external surface of the motor cycle helmet. However, the ornament must also be sufficiently tough and tear resistant in order to stand up to use in the normal environment to which a motor cycle helmet is subjected. That is, all projecting corners and edges of the ornament must be capable of withstanding abrasion, the paint or coloring must be sufficiently adhered as to not be removed by scratching, the ornament must remain adhered to the helmet even under conditions of extreme cold and extreme heat, and the ornament must not fade or discolor or crack following exposure to intense sunlight or rain.

The sculpture or ornament is preferably formed of a silicone rubber, preferably a thermosetting liquid silicone rubber composition comprising one or more of addition-reaction-curing liquid silicone rubber compositions that are composed of alkenyl-containing diorganopolysiloxane, SiH-containing organohydrogenpolysiloxane, and reinforcing filler and that are cured by platinum group metal catalysts to yield silicone rubber; organoperoxide-curing liquid silicone rubber compositions that are composed of alkenyl-containing diorganopolysiloxane and reinforcing filler and that are cured by organoperoxide to yield silicone rubber; and condensation-reaction curing liquid silicone rubber compositions that are composed of OH-containing diorganopolysiloxane, SiH-containing organohydrogenpolysiloxane, and reinforcing filler and that are cured to yield silicone rubber by condensation-reaction catalysts such as organotin compounds, organotitanium compounds, platinum group metal catalysts, etc. Among these the addition-reaction-curing liquid silicone rubber compositions are preferred for their high cure rate and very uniform cure.

A particularly preferred rubber composition for use in the present invention is a curable silicone rubber composition as disclosed in U.S. Pat. No. 5,516,832 (Kennan, et al.), the disclosure of which is incorporated herein by reference. The composition disclosed in this patent contains a silicone gum, resin reinforcing filler and a plasticizer, the plasticizer being a polybutylene oligomer or a combination of short-chain, hydroxy-terminated silicone oil and the polybutylene oligomer, and is curable with the aid of an organic peroxide. This silicone rubber composition, when cured, exhibits a reduced modulus and improved tear strength. More particularly, a plasticizer consisting essentially of a certain polybutylene oligomer, or a combination of a hydroxy-terminated short-chain diorganopolysiloxane and the polybutylene oligomer, can be employed in a conventional silicone rubber base or stock to reduce the modulus and improve tear strength of the cured rubber. The silicone rubber base is prepared, mixed with an organic peroxide catalyst, and may then be fabricated into a silicone rubber article by conventional methods such as extrusion, injection molding, compression molding, etc., and may then be cured under conditions which depend upon the activity and half life of the particular peroxide employed. Typically, the cure is carried out at about 116° C. for a period of about 5–10 minutes. The composition is preferably 100 parts by weight of diorganopolysiloxane gum, 10–75 parts by weight by reinforcing filler, the above mentioned polybutylene oligomer, and optionally a hydroxy-terminated diorganopolysiloxane.

More specifically, the diorganopolysiloxane is a high consistency gum having a degree of polymerization of about 2,000 to about 25,000, preferably 2,000 to 8,500. The diorganopolysiloxane may be a linear or branched polymer or copolymer wherein the organic groups are independently selected from hydrocarbon and halogenated hydrocarbon radicals having 1 to 6 carbon atoms, such as alkyl radicals having 1 to 6 carbon atoms, alkenyl radicals having 2 to 6 carbon atoms, aryl radicals such as phenyl, halogenated alkyl radicals having 3 to 6 carbon atoms, aralky radicals or cycloaliphatic radicals having 5–6 carbon atoms. In order to facilitate crosslinking by an organic peroxide catalyst it is preferred that the gum contain up to about 5 mole percent alkenyl radicals, such as vinyl radicals, either along the chain or at the chain ends. Most preferably, up to about 2 mole percent vinyl radicals are present in each gum molecule. Aside from this consideration, the nature of the terminal groups on the diorganopolysiloxane gum is not critical for the purposes of the present invention. They may be illustrated by such groups as trimethyisiloxy, dimethylphenylsiloxy, diethylphenylsiloxy, dimethylvinylsiloxy, dimethylhexenylsiloxy and dimethylhydroxysiloxy, with dimethylvinylsiloxy being preferred.

Examples of suitable diorganopolysiloxanes include polydimethylsiloxane homopolymers, polymethylhexylsiloxane homopolymers, copolymers of dimethylsiloxane units and methylphenylsiloxane units, homopolymers of methyl-3.3, 3-trifluoropropylsiloxane units, copolymers of dimethylsiloxane units and methylhexylsiloxane units, copolymers of dimethylsiloxane units and methylchloropropylsiloxane units, copolymers of dimethylsiloxane units and methylbeta-phenylethylsiloxane units, copolymers of dimethylsiloxane units and methylcyclohexylsiloxane units and copolymers of dimethylsiloxane units and methylhydrogensiloxane units, to name but a few. Again, it is preferred that up to about 5 mole percent of alkenyl-containing siloxane units are interpolymerized within the above mentioned polymer or copolymer systems. Mixtures of two or more such gums may be employed as the diorganopolysiloxane.

The ornament must be capable of withstanding both very cold temperatures and very hot temperatures. A silicone rubber composition that can used to make a silicone rubber compound having good processability, good molding properties, and good physical properties as a result of curing, and particularly having good resistance to both heat and cold, is disclosed in U.S. Pat. No. 5,428,097 (Kobayashi). The silicone rubber composition comprises a diorganopolysiloxane containing vinyl groups, a fluorine resin powder, an organopolysiloxane containing units of a specific formula, a reinforcing silica powder, and a curing agent.

U.S. Pat. No. 5,401,781 (Hagen) teaches a process for forming a cured article of consistent shape from a hydrolyzable siloxane composition without the problem of non-uniformity that results from significant die swell upon extrusion and from shrinkage upon curing.

Since a motorcycle helmet is conventionally worn in an environment which may be exposed to oil, gas or other hydrocarbons solvents, the silicone is preferably an oil-resistant silicone rubber. U.S. Pat. No. 5,399,602 (Matsushita, et al.) teaches an oil-resistant silicone rubber composition that undergoes little swelling even when used in regular or continuous contact with mineral oil-based lubricating oil such as engine oil. The oil-resistant silicone rubber composition comprises: (A) a dimethylsiloxane-3,3, 3-trifluoropropylmethyl-siloxanemethylvinylsiloxane copolymer gum that contains 0.001 to 5 mole percent methylvinylsiloxane unit, (B) a hydrocarbon oil or diorganopolysiloxane oil wherein the total in each diorganopolysiloxane oil molecule of the number of silicon-bonded hydrogen atoms and the number of functional groups reactive with component (A) or (C) is less than two, (C) a reinforcing filler, and (D) a curing agent in a quantity sufficient to cure the composition.

Where it is desired to have higher structural integrity in part or all of the decorative ornament, this can be accomplished by adding about 20–50% by weight of a modulus graphite fiber, based on the combined weight of the fiber and resin, to a resin matrix comprising about 20–43% by weight of a flexible epoxy comprising a linoleic dimer acid glycidyl ester epoxy, about 12–35% by weight of a stiff epoxy and about 35–61% by weight of a flexible cross-linking agent as disclosed, for example, in U.S. Pat. No. 4,304,694 (Scola, et al.).

It is essential that the decorative ornament be capable of either adhering directly to the outer surface of a motorcycle helmet, or is capable of being adhered to the outer surface of a motorcycle helmet by use of an adhesive. A room temperature curable organopolysiloxane composition is disclosed in U.S. Pat. No. 5,405,889 (Hatanaka, et al.). This organopolysiloxane composition has a highly durable adhesion that bonds well to various substrates such as glass, plastics and metals through contact-curing and exhibits an excellent early-cure adhesiveness. The composition cures to give a silicone rubber that is highly water-resistant and exhibits long term retention of its bonding strength even in hostile ambients such as immersion in hot water. The composition comprises a hydroxyl-terminated or alkoxy-terminated organopolysiloxane, an inorganic filler, a rosin ester in which the ester is a polyol, a reaction mixture from aminoalkylalkoxysilane and epoxyalkylalkoxysilane, and a curing catalyst. The composition is paintable. The composition may additionally contain an alkoxysilane crosslinker to adjust the curability and post-cure strength of the composition. The composition may contain other plasticizers, fixatrophic agents, colorants, adhesion promoters and anti-mold compounds. However, in practice, in order to reduce inventory and storage space requirements, it is preferred to simply premold a number of ornaments and to simply adhere them to a helmet as required.

Yet further compositions capable of being employed in the present invention are those disclosed in U.S. Pat. No. 4,111,890 (Getson, et al.) which teaches a organopolysiloxane composition which is stable under anhydrous conditions, but when exposed to atmospheric moisture cures to an elastomeric solid.

In the event that it is desired to improve the tensile strength of silicone rubber compositions, additives such as disclosed as U.S. Pat. No. 4,202,812 (Murray) may be employed. In particular, certain acryloxyalkylsilanes may be added to a silicone rubber base, preferably an elastomeric polydiorganosiloxane base.

Since it is highly desirable to have the decorative ornament high in impact resistance and strength and yet low in weight, it is desirable to employ fillers which reduce the weight of the ornament, such that the weight of the motorcycle helmet is not unnecessarily increased by the addition of the decorative ornament. U.S. Pat. No. 5,246,973 (Nakamura, et al.) teaches the introduction of a foamable silicone rubber composition that evolves neither toxic gas nor hydrogen, does not suffer from inhibition of cure to give silicone rubber, and which cures to give a silicone rubber foam containing uniform microcells. The foamable silicone rubber comprises a thermosetting liquid silicone rubber composition and thermally expansible hollow plastic microparticles. In accordance with the present invention these expansible hollow plastic microparticles are preferably injection molded into the center or core of the decorative ornament so as to leave a durable and tear proof skin on the ornament. The Nakamura et al patent teaches use of silicone rubber foams as seals, packings, gaskets, O-rings, and so forth. As disclosed in this patent, it is preferred not to use thermally decomposable blowing agents which have problems of toxicity or odor of the associated decomposition gas. It is also preferred not to use a hydrogen curing gas due to the explosive nature of hydrogen. The thermal setting liquid silicone rubber composition and hollow plastic microparticles of Nakamura et al are mixed or kneaded and foamed by introducing into an oven at 140☜ C.

The properties of the silicone rubber composition may be varied as desired, either to soften the product or improve the mechanical strength of the cured product, by the addition of various fillers. These fillers are exemplified by reinforcing fillers such as precipitated silica, fumed silica, calcined silica, fumed titanium oxide, and so forth; nonreinforcing fillers such as quartz powder, diatomaceous earth, asbestos, aluminosilicic acids, iron oxide, zinc oxide, calcium carbonate, and so forth; and the preceding fillers after treatment with an organosilicon compound such as an organosilane; organopolysiloxane, and so forth, and softeners or plasticizers such as oils. Insofar as the object of the present invention is not impaired, the organopolysiloxane composition of the present invention may contain trace or small quantities of an additive that inhibits the curing reaction, i.e. acetylenic compounds, hydrazines, triazoles, phosphines, and mercaptans. The following may also be added on an optional basis: pigments, heat stabilizers, flame retardants, adhesion promoters, etc.

Resort may also be had to U.S. Pat. No. 3,615,972 (Morehouse, Jr., et al.) teaching microspheres which encapsulate a liquid blowing agent. Heating of the microspheres causes expansion. The microspheres are useful for moldings in a preferred embodiment of the present invention where such microspheres are included in either the backing of the decorative ornament or in the core of the decorative ornament. In any case, it is desired to have the blowing agent spaced apart from the visible surface of the decorative ornament, so as not to detract from the visible appearance, skin tear strength, and abrasion resistance characteristics of the decorative ornament.

In the case that it is desired to impart a more rubbery or fleshy feel to the decorative ornament, a thermoplastic elastomer gelatinous composition as disclosed in U.S. Pat. No. 5,334,646 (Chen) may be employed. Such gelatinous composition is formed from an intimate melt blend admixture of poly(styrene-ethylenebutylene-styrene) triblock copolymer and high levels of plasticizing oil, and is disclosed as being particularly useful for toys, therapeutic hand exercising grips, shock absorbers, acoustical isolators, components for cushions, among other things. The gelatinous elastomer product has high dimensional stability, excellent crack, tear, craze and creep resistance, improved tensile strength and high elongation. The gelatinous elastomer has excellent process ability for cast molding. The patent is based on the discovery that high viscosity triblock copolymers which, by themselves, lack the desired properties, when combined with selected plasticizing oils with an average molecular weight of from about 200–700 produces a triblock copolymer with an extremely soft and highly elastic material having good gel rigidity and substantially without oil bleed out, alone with high tensile strength and elongation and other desirable combinations of physical properties. The composition is excellent for cast molding and the molded products have various excellent characteristics. The disclosed intended utilities such as therapeutic hand exercising grips, crutch cushions, cervical pillows, bed wedge pillows, leg rests, neck cushions, mattresses, bed pads, elbow padding, thermal pads, wheel chair cushions, helmet liner, and soles for orthopedic shoes as well as toys, fishing bait, high vacuum seals show their versatility and applicability to the present invention. The compositions disclosed in the patent can be cast onto various substrates such as metals, ceramics, glass, plastic, etc.

Another preferred silicone elastomer which is preferably used to form only part of the ornamental sculpture, either as a layer between a harder external surface and the motorcycle helmet or to impart a soft and fleshy feel to the external surface, is a low hardness silicone elastomer which is known for use as a resilient support or form block in the stamping of sheet metal workpieces by the elastoforming of ultra-thin steel sheeting. The silicone elastomers remain stable and non-migrating under the conditions of stamping and are thus capable of withstanding the forces to which a motorcycle helmet surface is subjected during the normal course of wear. The silicone elastomer include a plasticizer such as an organic or mineral hydrocarbon oil, diorganopolysiloxane oil, mixed organic/diorganopolysiloxane polymer and certain organic plasticizers which are compatible with silicones, such as polyoxyalkylene/polyorganosiloxane block copolymers, polyalkylbenzenes obtained by alkylation of benezene with olefins containing a long linear or branched chain, or petroleum cuts having a high boiling point and consisting of aliphatic and/or aromatic hydrocarbons. This plasticizer is added to an elastomer originating from the cross-linking, preferably by casting, of a fluid organopolysiloxane composition which cross-links either at ambient temperature or when heated to a temperature which is generally below 150° C., by polycondensation or by polyaddition reactions in a presence of a suitable metallic or organic catalyst. The plasticizer, especially when it is a silicone oil, remains incorporated in the elastomer network, even when the later is subjected to the very severe pressure conditions of elastoforming. The fluid organopolysiloxane compositions which are capable of being crosslinked by casting in the presence of a metal or organic catalyst are those compositions in most cases formulated in the form of two-component (or 2-pack) compositions which crosslink either by polyaddition reactions substantially by the reaction of ═SiH groups borne by a silane or a straight or branched chain organopolysiloxane, or of vinyl groups bonded to the silicone atoms of an organopolysiloxane, in the presence of a compound of a platinum group metal, or by polycondensation reactions of an alpha, omega-dihydroxydiorganopolysiloxane oil with a crosslinking agent, which is a silane bearing at least three hydrolyzable groups (typically alkoxy groups) or a polyalkoxysilane originating from the partial hydrolysis of this silane, in the presence of a metal catalyst, typically a tin compound and/or an organic compound such as amines.

Where the decorative ornament itself does not have sufficient adhesive properties to be cast directly onto a helmet, or where it is desired to prepare the decorative ornament separately and to adhere such onto a helmet on an as needed basis, the decorative ornament can be adhered to the motorcycle or other helmet by use of various adhesives. Preferred among these are epoxy adhesives such as the epoxy adhesive for bonding automotive parts as disclosed in U.S. Pat. No. 5,001,193 (Golden). The adhesive is a high performance two part epoxy structural adhesive suitable for bonding plastics and composites such as automotive sheet molding compound and bulk molding compound. The adhesives exhibit excellent toughness, high temperature strength and rapid cure. This adhesive is preferable considering that the time required to build sufficient green strength to adhere the decorative ornament to the helmet is approximately 60 seconds. The adhesive is capable of withstanding the heat in a automobile engine compartment. Pigments or other fillers may be included in the adhesive.

A further adhesive having fast curing properties and high shear strength as well as relatively high peel is disclosed in U.S. Pat. No. 4,766,186 (Sellstrom, et al.), wherein a mixture of epoxy resin, polyether diureide, triactulate, polyethyleneglycol diureide, and the accelerator are allowed to self cure at a temperature between 0° C. and 45° C.

While most epoxy adhesives are known as "two component" adhesives in view the requirement to mix the resin with a hardener or curing agent prior to use, U.S. Pat. No. 4,459,398 (Dearlove, et al.) teaches a high strength 1-part epoxy adhesive composition. The composition cures rapidly at relatively low temperatures and is based on a diglycidyl ether of bisphenol A reacted with glycerol and natural oils and a unique triple catalyst system of metal imidazole salt, dicyandiamide and a cyclic latent curing agent that liberates diethylenetriamine when heated. Due to the high curing temperatures, such epoxy adhesives are not preferred.

An epoxy adhesive composition having excellent resistant to water is disclosed in U.S. Pat. No. 4,336,367 (Morris, et al.). A particularly good light-transmitting adhesive composition having high conductivity, high volume resistivity and high dielectric and mechanical strength is closed in U.S. Pat. No. 4,211,685 (Konovenko, et al.).

It may in certain cases be desired, after molding, to impart texturing, patterns, or to cause the formation of raised letters, or to add details which cannot be added due to constraints of the molding operation, or for customization purposes. This can be accomplished by adding into the elastomer of the decorative ornament a layer containing thermally expandable microspheres as disclosed in U.S. Pat. No. 4,044,176 (Wolinski, et al.). Microspheres are incorporated in unexpanded form as a dispersed phase. The microspheres may be included in the elastomeric silicone resin or may be coated onto the resin, for example, by precoating the mold with the expandable material prior to injection of the elastomer into the mold. The three dimensional effect is then obtained by selectively heating the microspheres to expand them, usually at a temperature of about 90° to 150° C. In this way the owners name, nickname, or favorite logo may be formed onto the helmet.

EXAMPLE 1

This Example teaches how to apply a three dimensional decorative flame ornament 1 to a motorcycle helmet 2 as shown in FIG. 1. First, an injection mold is prepared and a flame ornament 1 as shown in FIG. 1 is cast of a two-part silicone rubber known as SILASTIC® M RTV silicone rubber. SILASTIC® M RTV silicone rubber curing agent is a liquid silicone rubber including aluminum chromium cobalt oxide, dimethylvinylated and trimethylated silica, and dimethyl, methylhydrogen siloxane, as well as dimethyl siloxane, dimethylvinyl-terminated, dimethyl, methylhydrogen siloxane, methylvinylsylco siloxanes. It may also contain a quartz filler. While SILASTIC® was developed by Dow Corning as a flexible mold making material for use with urethane foams and other casting plastics, the present invention uses the silicone rubber for the decorative ornament itself rather than as a mold. This silicone rubber is preferred for it's ability to cure rapidly at normal ambient conditions and it's capability of delivering highly detailed reproductions.

A light coat of release agent made of a 5% solution of petroleum jelly in a mineral spirit solvent is sprayed or wiped onto the pattern of the mold as a mold release agent.

Separately, an amount of silicone rubber base is poured into a metal can and curing agent is added to the silicone rubber base in the proportion of 10 parts base to 1 part curing agent by weight. The base and curing agent are mixed with manual stirring with care not to entrap air in the silicone material. The silicone rubber remains flowable and pourable for about 1–1½ hours after the curing agent is added. The full cure of the silicone rubber occurs by a reaction between the base polymer and the curing agent requiring approximately 24 hours after the addition- of the curing agent at room temperature. Vulcanization can be accelerated by heating the catalyzed material, but this may bring about a slight shrinkage. Care is taken to insure an absence of sulfur containing compounds and/or organometallic salt containing compounds such as organic rubbers and many RTV silicone rubbers in the mold since these materials may inhibit polymerization.

Figure 2:
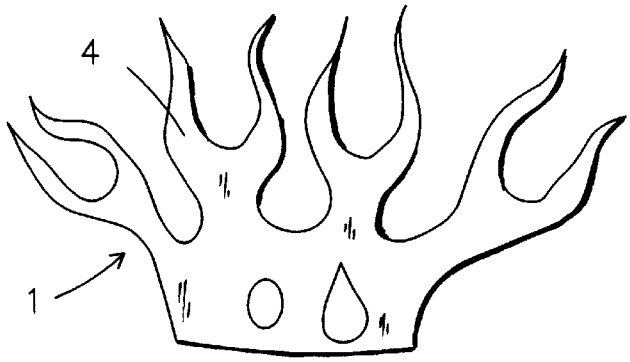
FIG. 2 is a back view of the flame ornament after casting.
Figure 3:
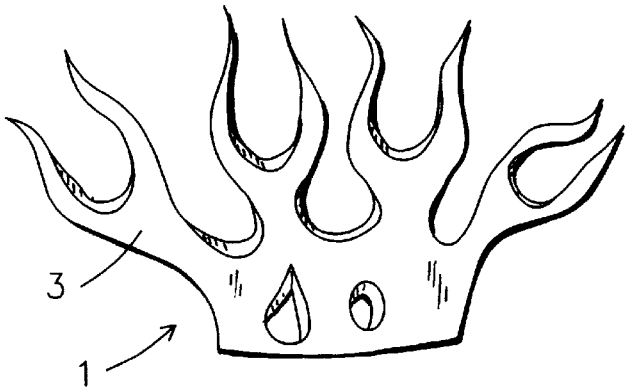
FIG. 3 is a front view of the flame ornament after casting.
Figure 4:
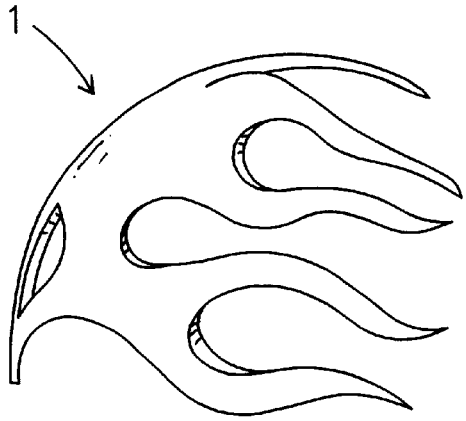
FIG. 4 shows the flame ornament in side view taking on the contour of the helmet shown in FIG. 5.
Figure 5:
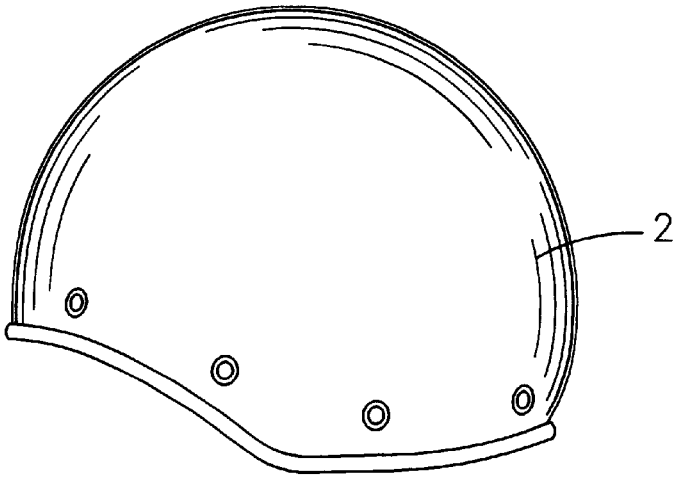
FIG. 5 is a side view of a helmet.

The decorative ornament once removed from the mold, is highly detailed and, if cured at room temperature, has no noticeable shrinkage. While the ornament 1 when removed from the mold as shown in FIGS. 2 and 3 is generally planar, the flame ornament is flexible and can be readily conformed to the spherical surface of the motorcycle helmet 2 as shown in FIGS. 1, 4 and 5.

In Example 1 a white pigment is blended in to the silicone rubber so that the ornament leaving the mold is completely white. The color scheme of the motorcycle helmet is not relevant, but the color of the motorcycle helmet preferably contrasts with the flame design color scheme. Since the flames are intended to contrast with the paint scheme of the helmet (which is usually black), it is easiest to air brush in the detailing of a flame pattern (such as a pattern beginning with white at a part of the ornament closest to the forehead progressing to yellow, orange and red at the tips of the flames closest to the back of the head) prior to applying the ornament to the helmet. It will be readily apparent that spray painting various shades over this separate ornament is a much easier process than separating masking, painting progressive layers of colors on a one dimensional motorcycle helmet.

The flame ornament 1 is thus painted for detailing and the decorative ornament is subsequently adhered to the motorcycle helmet. Obviously, it would be possible to adhered the three dimensional flame ornament to the helmet prior to painting so that the customer may customize his own helmet.

Next, the motorcycle helmet 2 to which the flame ornament is to be applied is vigorously cleaned with a highly volatile solvent such as alcohol. The ornament 1 is then adhered to the motorcycle helmet, preferably by application of a two-component room-temperature curing epoxy adhesive such as ARALDITE® 2043, a product of Ciba, to the back surface 4 of the ornament 1. Araldite® 2043 is a very rapid-cure, multi-purpose adhesive which will gel in 90 seconds at room temperature and is capable of bonding a wide variety of metals, ceramics, glass, rubbers, rigid plastics, and most other materials in common use. Araldite® 2043 is desirable for it's transparent bond line and a flexible bonding joint. The resin is typically mixed with hardener at a ratio of 1:1 in terms of either weight to volume. The adhesive is typically provided in the form of dual syringes and thus measuring the correct ratio of hardener and resin is greatly simplified. Total curing time at 25° C. is between 5 minutes and 2 hours. A layer of adhesive of between 0.002 and 0.004 inches thick will normally impart the greatest lap shear strength. For easiest application, the adhesive should be applied to the back surface 4 of the ornament 1 and the ornament pressed against the motorcycle helmet 2 with even contact and even overall pressure.

EXAMPLE 2

During the bonded process heat was generated and the fiberglass motorcycle helmet soften. When attempting to separate the decorative ornament from the helmet, the decorative ornament would internally tear. For complete separation the decorative ornament had to be scraped or abraded from the helmet. After scraping or abrading off a portion of the decorative ornament, an inspection showed a permanent marring of the helmet by the bonding process.

The underlining surface of the decorative ornament has substantially the same outline along the perimeter as the outer surface. The outline of the underlying and outer surfaces of different configuration is shown in the figures.

Example 2 involves the addition of a demon head to the front of a helmet. Unless indicated otherwise, the same materials and techniques as set forth in Example 1 are repeated here.

Figure 6:
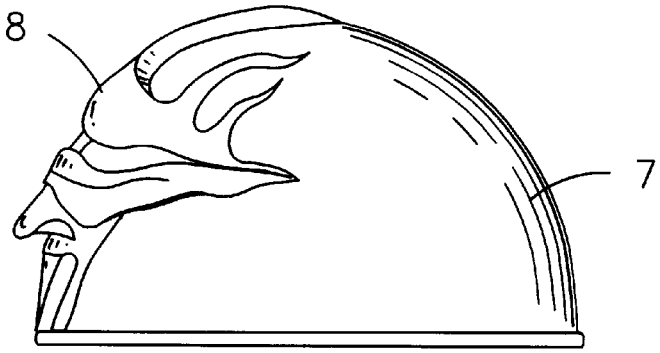
FIG. 6 is a side view of a second embodiment of the invention showing a three dimensional decorative demon ornament applied to the front of a motorcycle helmet.
Figure 7:
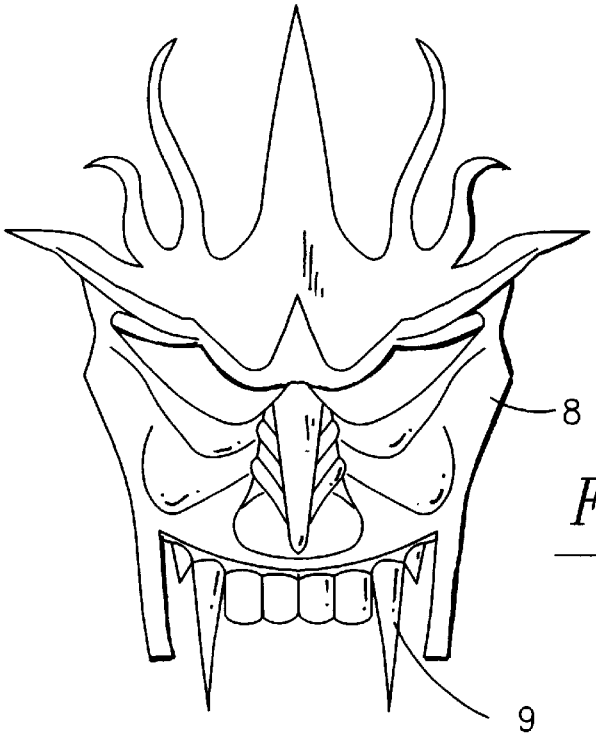
FIG. 7 is a front view of the demon ornament after casting.
Figure 8:
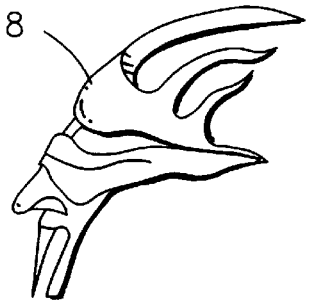
FIG. 8 shows the demon ornament in side view taking on the contour of the helmet shown in FIG. 9.
Figure 9:
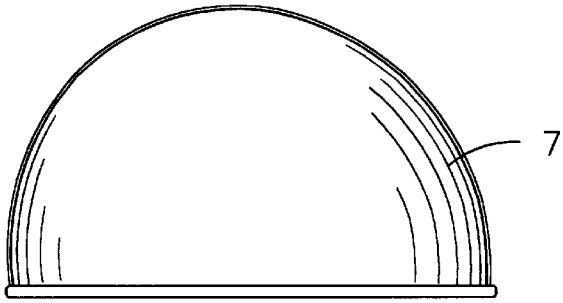
FIG. 9 is a side view of a helmet.

A decorative demon head sculpture 8 as shown in FIGS. 7 and 8 is cast of SILASTIC®, and painted with a black paint. Detailing (eye whites, teeth, lips) is air brushed onto the black demon head. The head is cast with a back surface being concave so as to fit flush against the front surface of the helmet 7. After painting, epoxy adhesive is applied to the back of the demon head ornament and the ornament as shown in FIG. 8 is pressed against helmet 7 as shown in FIG. 9 until adhered as shown in FIG. 6.

A significant feature of the demon head is that teeth 9 project outward from the helmet, yet do not constitute a safety hazard nor are they liable to break. This is attributable to the flexible nature of the teeth.

EXAMPLE 3

Example 3 involves the application of a brain sculpture 10 to essentially the entire surface of an abbreviated helmet 11 commonly referred to as a skull cap. Unless indicated otherwise, the same materials and techniques as set forth in Example 1 are repeated here.

Figure 10:
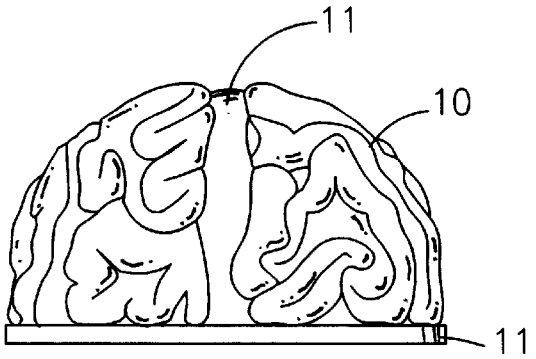
FIG. 10 is a front view of a third embodiment of the invention showing a three dimensional decorative brain ornament applied to a motorcycle helmet.
Figure 11:
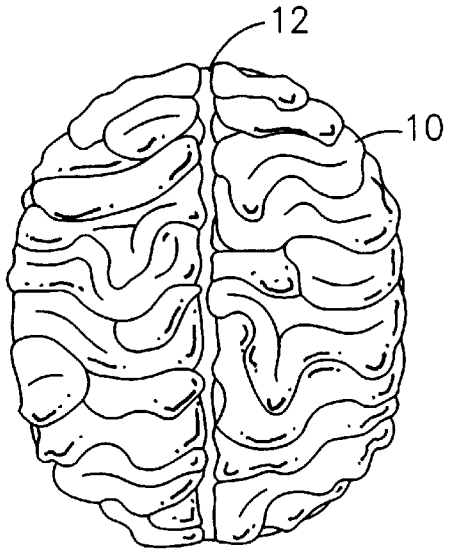
FIG. 11 is a top view of the brain ornament after casting.
Figure 12:
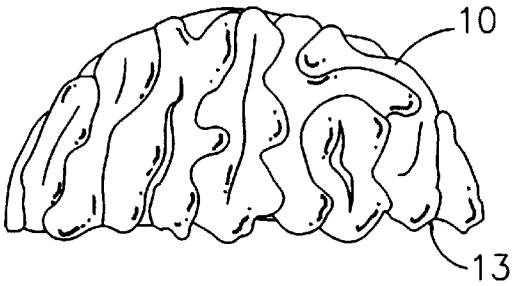
FIG. 12 shows the brain ornament in side view taking on the contour of the helmet shown in FIG. 13.
Figure 13:
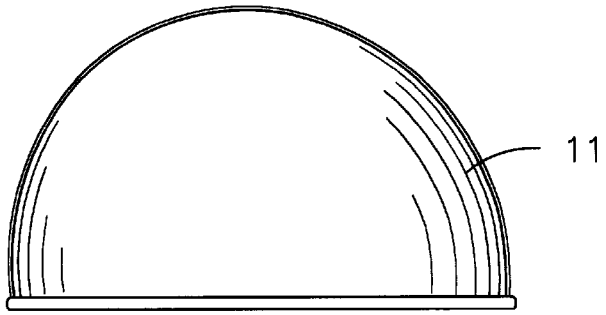

First, a hemispherical sculpture having an outer contour representing a brain 10 is formed as shown in FIGS. 11 and 12. When casting this sculpture as a single piece, a dividing segment 12 is included in the sculpture. This dividing segment may either be left intact or trimmed away prior to application of the brain sculpture to the helmet. The sculpture has a concave inner surface 13 which conforms to the outer surface of the helmet as shown in FIG. 13. The sculpture is painted, the dividing strip 12 is trimmed away, adhesive is applied to the inner surface of the sculpture, and the sculpture is applied to the clean outer surface of the helmet 11 to produce a helmet having the appearance of an exposed brain as shown in FIG. 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. A helmet bearing a sculptured ornament, comprising a helmet having a sculptured ornament wherein said sculptured ornament is formed of a elastomeric material having a smooth underside for conforming to the outer contour of said helmet, wherein said sculptured ornament is permanently adhered to said helmet and wherein said sculptured ornament is flexible and the underlying surface of the sculptured ornament conforms to the surface of the helmet.

2. A helmet as in claim 1, wherein said elastomeric material is a thermosetting liquid silicone rubber composition comprising one or more of addition-reaction-curing liquid silicone rubber compositions that are composed of alkenyl-containing diorganopolysiloxane, SiH-containing organohydrogen-polysiloxane, and OH-containing diorganopolysiloxane.

3. A helmet as in claim 1, wherein said sculpture covers 80% or more of the helmet.

4. A helmet as in claim 1, wherein said sculpture exhibits two or more colors.

5. A helmet as in claim 1, wherein said helmet is a motorcycle helmet.

6. A helmet as in claim 1, wherein said sculpture represents flames.

7. A helmet as in claim 1, wherein said sculpture represents a brain.

8. A helmet as in claim 1, wherein said sculpture represents a face.

9. A helmet as in claim 1, wherein said sculpture includes hollow microspheres formed by a blowing agent.

10. A helmet as in claim 1 wherein the sculptured ornament is a molded product where the outer surface is sculptured and the underlying surface has substantially the same outline along the perimeter as the outer surface.

11. A motorcycle helmet as in claim 10, wherein the permanent adherence softens and mars the surface of the helmet.

12. A helmet as in claim 1, wherein the elastomeric material is selected from the group consisting of rubber, latex, and silicone.

13. A helmet bearing a sculptured ornament, wherein said helmet is fiberglass, wherein said sculptured ornament is formed of an elastomeric material, wherein said sculpture is permanently adhered to said fiberglass helmet; and wherein said sculpture covers 30% or more of the surface of the helmet.

14. A helmet as in claim 13, wherein said sculpture covers 50% or more of the surface of the helmet.

15. A helmet bearing a sculptured ornament, wherein said helmet is fiberglass, wherein said sculptured ornament is formed of an elastomeric material, wherein said sculpture is permanently adhered to said fiberglass helmet; and wherein said sculpture extends no more than 1 inch from the surface of the helmet.

16. A helmet as in claim 10, wherein said sculpture extends no more than ½ inch from the surface of the helmet.

17. A motorcycle helmet bearing a sculptured ornament, wherein said helmet is fiberglass, wherein said sculptured ornament is formed of an elastomeric material, wherein said sculpture is permanently adhered to said fiberglass motorcycle helmet;

and wherein said sculptured ornament is flexible and the underlying surface of the sculptured ornament conforms to the surface of the helmet.

18. A motorcycle helmet as in claim 17, wherein said the sculptured ornament is a molded product where the outer surface is sculptured and the underlying surface has substantially the same outline along the perimeter as the outer surface.

19. A motorcycle helmet as in claim 18, wherein the permanent adherence softens and mars the surface of the helmet.

* * * * *